US009330607B2

(12) United States Patent
Lee et al.

(10) Patent No.: US 9,330,607 B2
(45) Date of Patent: May 3, 2016

(54) DISPLAY DEVICE INCLUDING A GRAY COMPENSATOR AND METHOD OF DRIVING THE SAME

(71) Applicant: Samsung Display Co., Ltd., Yongin, Gyeonggi-do (KR)

(72) Inventors: Myung Woo Lee, Cheonan-si (KR); Soon Dong Kim, Pyeongtaek-si (KR); Ji Eun Park, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 349 days.

(21) Appl. No.: 13/840,916

(22) Filed: Mar. 15, 2013

(65) Prior Publication Data

US 2013/0241970 A1 Sep. 19, 2013

(30) Foreign Application Priority Data

Mar. 16, 2012 (KR) ..... 10-2012-0027164

(51) Int. Cl.
*G09G 5/10* (2006.01)
*G09G 3/34* (2006.01)
*G09G 3/32* (2016.01)

(52) U.S. Cl.
CPC ..... *G09G 3/3406* (2013.01); *G09G 3/3225* (2013.01); *G09G 2320/0252* (2013.01); *G09G 2320/0276* (2013.01)

(58) Field of Classification Search
CPC ..... G09G 3/3225; G09G 3/3406
USPC ..... 345/690
See application file for complete search history.

(56) References Cited

U.S. PATENT DOCUMENTS

| | | | | |
|---|---|---|---|---|
| 8,106,930 | B2 * | 1/2012 | Wang et al. | 345/697 |
| 8,149,200 | B2 * | 4/2012 | Bu et al. | 345/89 |
| 8,648,784 | B2 * | 2/2014 | Lee et al. | 345/94 |
| 2007/0097058 | A1 * | 5/2007 | Kim et al. | 345/98 |
| 2009/0091588 | A1 * | 4/2009 | Chen et al. | 345/690 |
| 2009/0251450 | A1 * | 10/2009 | Yamato et al. | 345/211 |

FOREIGN PATENT DOCUMENTS

| | | | |
|---|---|---|---|
| KR | 10-2004-0096273 | A | 11/2004 |
| KR | 10-2005-0002327 | A | 1/2005 |
| KR | 10-2008-0041524 | A | 5/2008 |
| KR | 10-2011-0027630 | A | 3/2011 |

* cited by examiner

*Primary Examiner* — Kwang-Su Yang
(74) *Attorney, Agent, or Firm* — Knobbe, Martens, Olson & Bear, LLP

(57) ABSTRACT

A display device is disclosed. In one embodiment, the display device includes a first conversion unit receiving gray data and outputting a gray data value of a second gamma curve, which has a luminance equal to a luminance of the gray data on a first gamma curve. The device may also include a memory storing a look-up table (LUT) which includes first and second data groups and compensated gray data for the second gamma curve. The device may further include a reference unit generating the compensated gray data based on the two converted gray data. Coordinates formed of i) each value in the first data group and ii) each value in the second data group may correspond to any one of the compensated gray data.

10 Claims, 7 Drawing Sheets

FIG.5

521

| | | R1 | | | | | | | | |
|---|---|---|---|---|---|---|---|---|---|---|
| | | 0 | 32 | 64 | 96 | 128 | 160 | 192 | 224 | 255 |
| R2 | 0 | 0 | 0 | 0 | 0 | 0 | 0 | 0 | 0 | 0 |
| | 32 | 46 | 32 | 32 | 28 | 28 | 28 | 28 | 26 | 28 |
| | 64 | 88 | 66 | 64 | 60 | 50 | 50 | 58 | 58 | 56 |
| | 96 | 120 | 100 | 90 | 96 | 92 | 92 | 91 | 90 | 93 |
| | 128 | 160 | 130 | 130 | 120 | 120 | 120 | 125 | 123 | 121 |
| | 160 | 190 | 170 | 165 | 163 | 160 | 160 | 160 | 160 | 160 |
| | 192 | 231 | 205 | 201 | 198 | 194 | 194 | 192 | 190 | 191 |
| | 224 | 255 | 232 | 232 | 230 | 220 | 220 | 225 | 224 | 224 |
| | 255 | 255 | 255 | 255 | 255 | 255 | 255 | 255 | 255 | 255 |

A2

A1

OD

FIG.7

1521

| | | R3 | | | | | | | | |
|---|---|---|---|---|---|---|---|---|---|---|
| | | 0 | 20 | 42 | 65 | 90 | 123 | 160 | 200 | 255 |
| R4 | 0 | 0 | 0 | 0 | 0 | 0 | 0 | 0 | 0 | 0 |
| | 20 | 30 | 20 | 19 | 18 | 18 | 18 | 18 | 18 | 18 |
| | 42 | 62 | 55 | 42 | 40 | 35 | 35 | 35 | 35 | 33 |
| | 65 | 89 | 80 | 77 | 65 | 62 | 61 | 58 | 58 | 58 |
| | 90 | 114 | 105 | 100 | 99 | 90 | 82 | 80 | 79 | 80 |
| | 123 | 160 | 142 | 140 | 137 | 135 | 123 | 115 | 113 | 113 |
| | 160 | 190 | 180 | 176 | 174 | 173 | 170 | 160 | 152 | 10 |
| | 200 | 225 | 215 | 211 | 210 | 209 | 209 | 205 | 200 | 193 |
| | 255 | 255 | 255 | 255 | 255 | 255 | 255 | 255 | 255 | 255 |

OD2

DISPLAY DEVICE INCLUDING A GRAY COMPENSATOR AND METHOD OF DRIVING THE SAME

CROSS-REFERENCE TO RELATED PATENT APPLICATION

This application claims priority from Korean Patent Application No. 10-2012-0027164 filed on Mar. 16, 2012 in the Korean Intellectual Property Office, the disclosure of which is incorporated herein by reference in its entirety.

BACKGROUND

1. Field

The described technology generally relates to a display device and a method of driving the same.

2. Description of the Related Technology

Response time is one of the factors used to evaluate the performance of a display device. The response time is the time required for a displayed image to change to another image. Examples of technique to measure the response time include back-to-white (BTW) response and gray-to-gray (GTG) response. The BTW response denotes the time required to change from black to white, and the GTG response denotes the average time required to change from a 10% gray level to a 90% gray level.

SUMMARY

One inventive aspect is a display device with reduced response time and improved display quality.

Another aspect is a method of driving a display device with reduced response time and improved display quality.

Another aspect is a display device comprising a first conversion unit receiving gray data and outputting a gray data value of a second gamma curve, which has a luminance equal to a luminance of the gray data on a first gamma curve, as converted gray data, a memory unit comprising a look-up table (LUT) which comprises a first data group, a second data group, and compensated gray data for the second gamma curve and a reference unit receiving two converted gray data from the first conversion unit and generating the compensated gray data located at an intersection of a value of the first data group and a value of the second data group, which correspond respectively to the two converted gray data, in the LUT of the memory unit, wherein coordinates comprised of each value in the first data group and each value in the second data group correspond to any one of the compensated gray data.

Another aspect is a method of driving a display device, the method comprising determining whether first gray data is the same as second gray data, performing a first conversion process for converting the first gray data and the second gray data into third gray data and fourth gray data when the first gray data is not the same as the second gray data, generating fifth gray data from the third gray data and the fourth gray data by referring to, an LUT and performing a second conversion process for converting the fifth gray data into sixth gray data, wherein the first conversion process converts gray data which corresponds to a first luminance on a first gamma curve into gray data which corresponds to the first luminance on a second gamma curve, the second conversion process converts gray data which corresponds to a second luminance on the second gamma curve into gray data which corresponds to the second luminance on a third gamma curve, and the LUT corresponds to the second gamma curve.

BRIEF DESCRIPTION OF THE DRAWINGS

FIG. 5 is a look-up table (LUT) according to an embodiment.

FIG. 7 is an LUT according to another embodiment.

DETAILED DESCRIPTION

An increase in the response time of a display device may result in the degradation of display quality such as the formation of afterimage on the screen. Therefore, reducing the response time is important in improving device performance. To reduce response time, a pixel driving transistor may be reset in each frame. Alternatively, compensated gray data which has a higher value than gray data of a frame may be generated, and gray voltages corresponding to the compensated gray data may be applied to pixels.

However, if a pixel driving transistor is reset in each frame, a transistor and wirings should be added to each pixel. This reduces the aperture ratio of the display and thus impedes an increase in resolution. If gray voltages higher than gray data of a frame are applied to pixels, when the brightness of the entire display panel is adjusted, compensated gray data cannot be generated according to the adjusted brightness, thereby causing, e.g., overshoot in an image.

Embodiments now will be described more fully hereinafter with reference to the accompanying drawings. The present disclosure may, however, be embodied in different forms and should not be construed as limited to the embodiments set forth herein. The same reference numbers indicate the same components throughout the specification. In the attached figures, the thickness of layers and regions is exaggerated for clarity. In at least one of the disclosed embodiments, the word "substantially the same" includes "the same" or "almost the same."

It will also be understood that when a layer is referred to as being "on" another layer or substrate, it can be directly on the other layer or substrate, or intervening layers may also be present. In contrast, when an element is referred to as being "directly on" another element, there are no intervening elements present.

Figure 1:
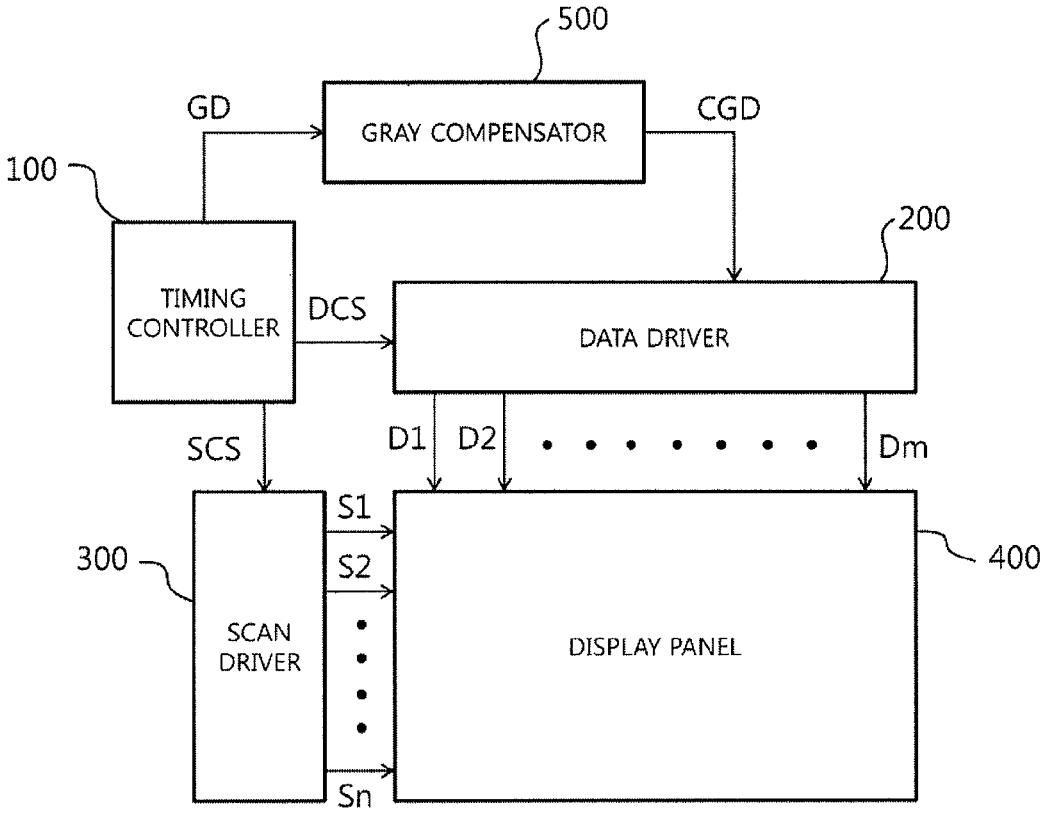
FIG. 1 is a block diagram of a display device according to an embodiment.

FIG. 1 is a block diagram of a display device according to an embodiment. Referring to FIG. 1, the display device according to the current embodiment may include a timing controller 100, a data driver 200, a scan driver 300, a display panel 400, and a gray compensator 500.

The timing controller 100 may control the data driver 20 and the scan driver 300 such that a desired image is displayed on the display panel 400. The timing controller 100 may generate a data control signal DCS for controlling the data driver 200 and transmit the generated data control signal DCS to the data driver 200. The timing controller 100 may generate a scan control signal SCS for controlling the scan driver 300 and transmit the generated scan control signal SCS to the scan driver 300. The timing controller 100 may transmit gray data GD to the gray compensator 500.

The data driver 200 may receive the data control signal DCS from the timing controller 100 and receive compensated gray data CGD from the gray compensator 500. The data driver 200 may generate gray signals D1 through Dm corresponding to the compensated gray data CGD and transmit the generated gray signals D1 through Dm to the display panel 400. In doing so, the data driver 200 may control gray levels of a plurality of pixels included in the display panel 400. The gray signals D1 through Dm may be voltages or currents, and the gray levels of the pixels may change according to sizes of the gray signals D1 through Dm. According to some embodiments, the gray signals D1 through Dm may be in the form of pulse width modulation (PWM) waves. In this case, the gray levels of the pixels may change according to widths of the PWM waves. The data driver 200 may control a time when the gray signals D1 through Dm are transmitted to the display panel 400 based on the data control signal DCS.

The scan driver 300 may receive the scan control signal SCS and generate scan signals S1 through Sn corresponding to the received scan control signal SCS. The scan signals S1 through Sn may be transmitted to the display panel 400 to control whether the pixels of the display panel 400 will receive the gray signals D1 through Dm.

The display panel 400 may include a plurality of pixels and display an image by controlling gray levels of the pixels. The gamma and maximum luminance of an image displayed on the display panel 400 may be the gamma and maximum luminance set for the display device or the display panel 400. According to some embodiments, the set gamma and the set maximum luminance can change. The set maximum luminance can be changed by changing a luminance setting of an image to be displayed on the display panel 400. According to some embodiments, the pixels may be a group of green, red and blue pixels. According to another embodiment, the pixels may be a group of green, red, blue, and white pixels. According to another embodiment, the display panel 100 may be a group of pixels of the same color, for example, a group of black pixels. Whether the pixels of the display panel 400 will receive the gray signals D1 through Dm may be determined by the scan signals S1 through Sn. The pixels of the display panel 400 may display gray levels corresponding to the received gray signals D1 through Dm.

Figure 2:
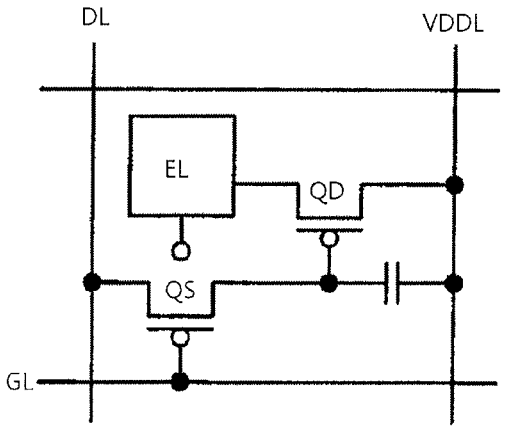
FIG. 2 is a circuit diagram of a pixel according to an embodiment.

FIG. 2 is a circuit diagram of a pixel according to an embodiment. A pixel included in the display panel 400 will now be described in detail with reference to FIG. 2. Referring to FIG. 2, one pixel may include an organic electroluminescent element EL, a switching element QS, a driving element QD, a gate line GL connected to the switching element QS, a data line DL, and a current supply line VDDL. One of the scan signals S1 through Sn may be transmitted to the gate line GL. One of the gray signals D1 through Dm may be transmitted to the data line DL. According to some embodiments, when a signal transmitted to the gate line GL is high, the switching element QS is turned on, thereby allowing a signal transmitted to the data line DL to be delivered to the driving element QD. The driving element QD may transmit the signal received from the data line DL to the organic electroluminescent element EL. Then, the organic electroluminescent element EL may emit light of a gray level corresponding to the signal received from the driving element QD.

In one embodiment as shown in FIGS. 1 and 2, the display panel 400 is an organic electroluminescent display panel. However, the display panel 400 is not limited to the organic electroluminescent display panel, and various types of display panels can be used as the display panel 400. For example, the display panel 400 may be a liquid crystal display (LCD) panel, an electrophoretic display panel, a light-emitting diode (LED) panel, an inorganic electroluminescent display panel, a field emission display (FED) panel, a surface-conduction electron-emitter display (SED) panel, a plasma display panel (PDP), or a cathode ray tube (CRT) display panel.

Referring back to FIG. 1, the gray compensator 500 receives the gray data GD and generates the compensated gray data CGD. In FIG. 1, the gray data GD is received from the timing controller 100. However, in some embodiments, the gray data GD may be received without through the timing controller 100. The gray data GD may include gray data of a first frame and gray data of a second frame which follows the first frame. The compensated gray data CGD may be generated by processing the gray data GD in order to reduce the response time of an image. The compensated gray data CGD may be gray data used to display an image of the second frame. When the gray data of the second frame is greater than the gray data of the first frame, the compensated gray data CGD may be greater than the gray data of the second frame. When the gray data of the second frame is smaller than the gray data of the first frame, the compensated gray data CGD may be smaller than the gray data of the second frame. The gray compensator 500 operating as described above can reduce the response time of the display device.

More specifically, when the gray data of the second frame is greater than the gray data of the first frame, gray signals D1 through Dm corresponding to gray levels which are intended to be displayed may not be transmitted. Instead, gray signals D1 through Dm higher than the gray signals D1 through Dm corresponding to the gray levels which are intended to be displayed on the display panel 400 may be transmitted. As a result, the gray levels of the pixels can reach the intended gray levels more quickly. Likewise, when the gray data of the second frame is smaller than the gray data of the first frame, gray signals D1 through Dm corresponding to gray levels which are intended to be displayed may not be transmitted. Instead, gray signals D1 through Dm lower than the gray signals D1 through Dm corresponding to the gray levels which are intended to be displayed on the display panel 400 may be transmitted. As a result, the gray levels of the pixels can reach the intended gray levels more quickly. The gray compensator 500 will now be described in greater detail with reference to FIG. 3.

Figure 3:
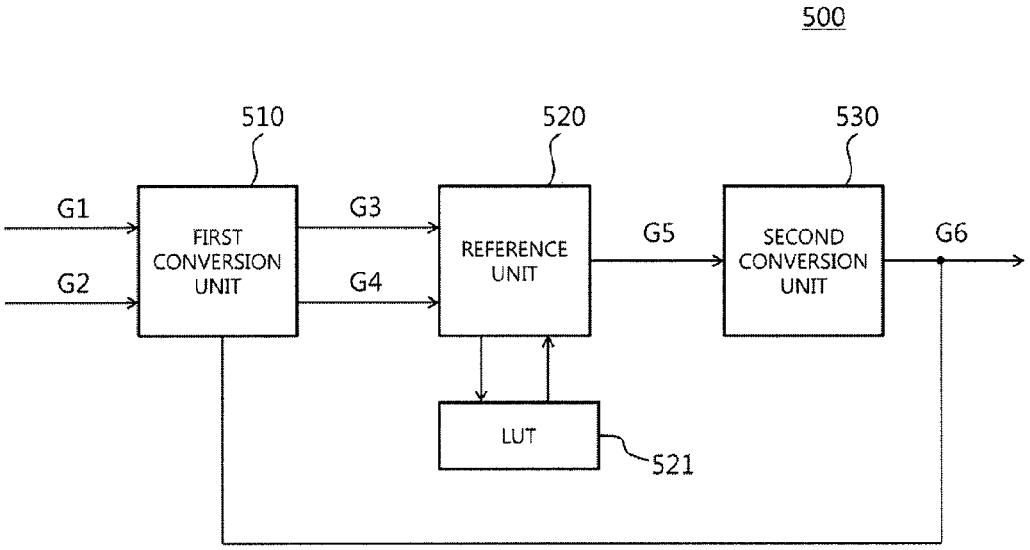
FIG. 3 is a block diagram of a gray compensator according to an embodiment.

FIG. 3 is a block diagram of a gray compensator 500 according to an embodiment.

Referring to FIG. 3, the gray compensator 500 may include a first conversion unit 510 and a reference unit 520.

The first conversion unit 510 may generate third gray data G3 and fourth gray data G4 based on received first gray data G1 and second gray data G2. The first gray data G1 and the second gray data G2 may be included in the gray data GD of FIG. 1. The first gray data G1 may be the gray data of the first frame, and the second gray data G2 may be the gray data of the second frame which follows the first frame. According to some embodiments, the second frame may follow the first frame. The first gray data G1 and the second gray data G2 may correspond respectively to luminances of the first frame and the second frame on a first gamma curve.

Generating the third gray data G3 and the fourth gray data G4 may be accomplished by a first conversion process in which the first gray data G1 and the second gray data G2 are converted into the third gray data G3 and the fourth gray data G4, respectively. Since the third gray data G3 and the fourth gray data G4 are converted from the first gray data G1 and the second gray data G2, respectively, they can also be referred to as converted gray data. In the first conversion process, gray data corresponding to a specific luminance on the first gamma curve may be converted into gray data corresponding to a luminance, which is equal to the specific luminance, on a second gamma curve. The first conversion process will now be described in greater detail with reference to FIG. 4.

Figure 4:
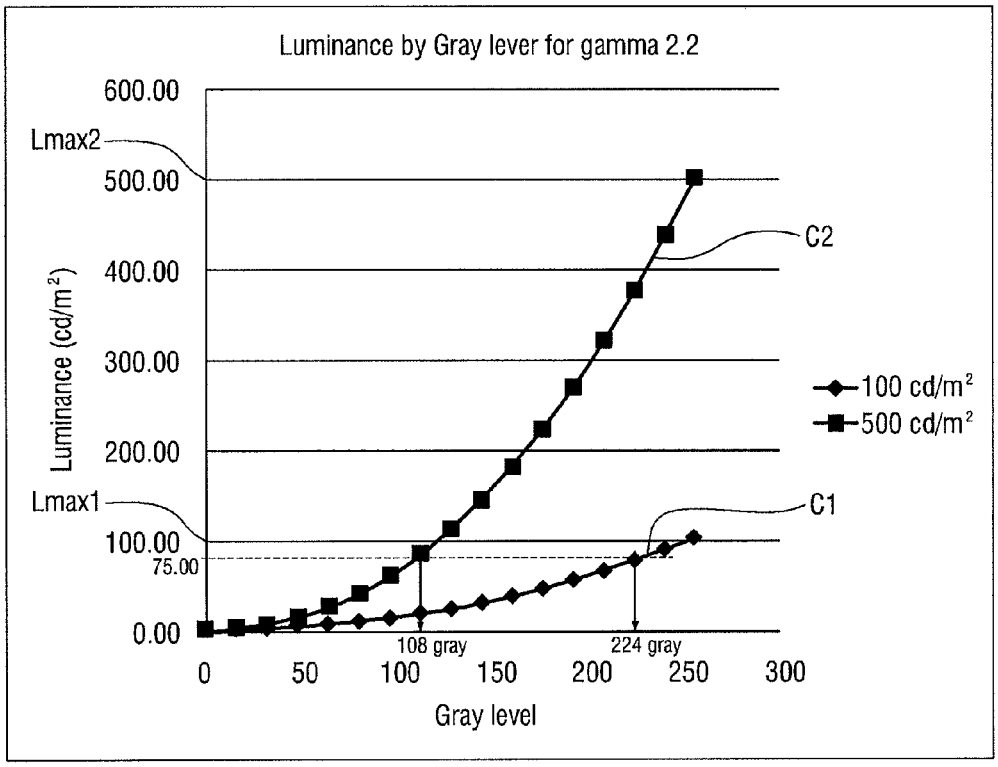
FIG. 4 is a graph of a first gamma curve and a second gamma curve according to an embodiment.

FIG. 4 is a graph of a first gamma curve and a second gamma curve according to an embodiment.

Referring to FIG. 4, the x axis of a gamma curve graph represents gray data, and the γ axis represents luminance corresponding to the gray data. A general gamma curve may be defined by a function of Equation (1) below.

$$\frac{L}{L\max} = \left(\frac{\text{gray}}{255}\right)^{\gamma}, \tag{1}$$

where L is luminance, Lmax is the maximum luminance of a gamma curve, gray is gray data, and γ is gamma. A value of 255 is the maximum value of gray data when the gray data has 8 bits. When the number of bits of the gray data is changed, the maximum value of the gray data may also change accordingly. In the current embodiment, a case where the gray data has 8 bits will be described as an example. The maximum luminance of the gamma curve may be a luminance corresponding to the maximum value that the gray data can have. For example, when the gray data has 8 bits, the maximum luminance of the gamma curve may be a luminance corresponding to a gray data value of 255. According to some embodiments, the maximum luminance may be a luminance, which corresponds to white color, on the gamma curve.

In FIG. 4, a first gamma curve C1 is a gamma curve whose Lmax is 100 cd/m$^2$ and γ is 2.2. In addition, a second gamma curve C2 is a gamma curve whose Lmax is 500 cd/m$^2$ and γ is 2.2. The above values of Lmax and γ are mere examples and can change according to the settings of the display device.

For example, when gray data on the first gamma curve C1 is 224, a luminance corresponding to the gray data is 75 cd/m$^2$. On the second gamma curve C2, gray data corresponding to the luminance of 75 cd/m$^2$ is 108. According to some embodiments, the first conversion process converts gray data representing a specific luminance on the first gamma curve C1 into gray data, which represents a luminance equal to the specific luminance, on the second gamma curve C2. Therefore, when the first gamma curve C1 and the second gamma curve C2 are set as illustrated in FIG. 4, the gray data of 224 may be converted into the gray data of 108 in the first conversion process.

If the maximum luminance of the first gamma curve C1 is Lmax1 and if gray data is gray1, the first gamma curve C1 may be defined by Equation (2).

$$\frac{L}{L\max 1} = \left(\frac{\text{gray}1}{255}\right)^{\gamma}. \tag{2}$$

If the maximum luminance of the second gamma curve C2 is Lmax2 and if gray data is gray2, the second gamma curve C2 may be defined by Equation (3).

$$\frac{L}{L\max 2} = \left(\frac{\text{gray}2}{255}\right)^{\gamma}. \tag{3}$$

As assumed above, the first conversion process converts gray data of a gamma curve into gray data, which corresponds to a luminance of the gray data, on a different gamma curve. Therefore, luminances L of Equations (2) and (3) are equal. Accordingly, Equations (2) and (3) can be combined and rearranged into Equation (4) for gray2.

$$\text{gray}2 = \left(\frac{L\max 1}{L\max 2}\right)^{\frac{1}{\gamma}} \times \text{gray}1. \tag{4}$$

That is, the first conversion process converts gray1 into gray2 using Equation (4).

According to some embodiments, the maximum luminance Lmax1 of the first gamma curve C1 may be substantially equal to the set maximum luminance of the display panel 400. In other words, a luminance of the first gamma curve C1 which represents white color may be substantially equal to a luminance of the display panel 400 which represents white color. According to some embodiments, if the maximum luminance Lmax1 of the first gamma curve C1 is substantially equal to the set maximum luminance of the display panel 400 and if the first gray data G1 is substantially the same as the second gray data G2, the first conversion unit 510 may output a value, which is substantially equal to the first gray data G1 or the second gray data G2, as sixth gray data G6. The sixth gray data G6 may be the compensated gray data CGD in FIG. 1. When the first gray data G1 and the second gray data G2 are substantially the same, gray levels equal to gray levels of a previous frame are displayed on the display panel 400. This reduces the need to reduce the response time in response to a change in gray level. Therefore, the compensated gray data CGD can be generated without using the reference unit 520 and a second conversion unit 530 which will be described later, thereby reducing the power consumption of the display device.

According to some embodiments, the maximum luminance Lmax2 of the second gamma curve C2 may be higher than the maximum luminance Lmax1 of the first gamma curve C1. If Lmax2 is lower than Lmax1, the gray data of the second gamma curve C2 cannot correspond to a luminance higher than Lmax2. Therefore, when Lmax2 is higher than Lmax1, the first conversion process can be performed in a more stable manner. According to some embodiments, Lmax2 may be substantially equal to the maximum value of the set maximum luminance of the display panel 400. When Lmax2 is substantially equal to the maximum value of the set maximum luminance, Lmax1 can be set to a value within a range lower than the maximum value of the set maximum luminance. Therefore, the first conversion process can be performed stably, irrespectively of the value of Lmax1.

Referring back to FIG. 3, the reference unit 520 may generate fifth gray data G5 based on the third gray data G3 and the fourth gray data G4 received from the first conversion unit 510. According to some embodiments, the reference unit 520 may generate the fifth gray data G5 by referring to a look-up table (LUT) 521. According to some embodiments, the display device may include a separate memory which stores the LUT 521, although not shown in the drawing.

FIG. 5 is a LUT 521 according to an embodiment. Referring to FIG. 5, the LUT 521 includes a first data group R1 on an axis, a second data group R2 on the other axis, and output data OD arranged in a matrix. Coordinates composed of each value in the first data group R1 and each value in the second data group R2 may correspond to any one of the output data OD. A value generated from gray data of an image, which matches a luminance on the second gamma curve C2, by referring to the LUT 521 may be the compensated gray data CGD for the image represented by the second gamma curve C2. That is, the output data OD may be the compensated gray data CGD for the second gamma curve C2. In other words, the reference unit 520 may output, as the fifth gray data G5, the output data OD at coordinates composed of the first data group R1 and the second data group R2, which correspond respectively to the third gray data G3 and the fourth gray data G4, in the LUT 521. The output fifth gray data G5 may be the compensated gray data CGD used to display the image of the second frame according to the second gamma curve C2.

The LUT 521 shown in the drawing is based on a gamma curve whose Lmax2 si 500 cd/m$^2$ and γ is 2.2. However, this is merely an example. Values of the first data group R1 and values of the second data group R2 may be arranged sequentially in order of size. In FIG. 5, the LUT 521 for 8-bit gray data is illustrated. However, this is merely an example. The LUT 521 may change according to a change in the number of bits of the gray data. In addition, in FIG. 5, the values of the first data group R1 and the values of the second data group R2 are arranged at intervals of 32. However, this is merely an example. Depending on embodiments, the intervals of these reference data can be diversely modified. For example, the values of the first data group R1 or the second data group R2 may be arranged at irregular intervals. In addition, according to some embodiments, the values of the first data group R1 and the values of the second data group R2 may include all values that gray data can have. That is, when the gray data has 8 bits, the first data group R1 and the second data group G2 may include all values ranging from 0 to 255.

The reference unit 520 may generate a value of the output data OD at an intersection of value of the first data group R1 which corresponds to the third gray data G3 and value of the second data group R2 which corresponds to the fourth gray data G4 as the fifth gray data G5. According to some embodiments, when a value corresponding to the third gray data G3 is not available in the first data group R1, the reference unit 520 may determine that the third gray data G3 corresponds to a value, which is most approximate to the value of the third gray data G3, in the first data group R1. For example, when the third gray data G3 is 100, the reference unit 520 may determine that the third gray data G3 corresponds to 93, which is most approximate to 100, in the first data group R1. When a value corresponding to the fourth gray data G4 is not available in the second data group R2, it is processed in the same way as for the third gray data G3. For example, when the third gray data G3 is 100 and the fourth gray data G4 is 60, the reference unit 520 may determine that the third gray data G3 corresponds to 96 in the first data group R1 and that the fourth gray data G4 corresponds to 64 in the second data group R2. Therefore, the reference unit 520 may determine 60 to be a value of the fifth gray data G5.

When the maximum luminance Lmax1 of the first gamma curve G1 is 200 cd/m$^2$, 168 can be obtained for the third gray data G3 and the fourth gray data G4 by performing the first conversion process on the maximum value of 255 of the first gray data G1 and the second gray data G2 using Equation (4). Therefore, when the maximum luminance Lmax1 of the first gamma curve C1 is 200 cd/m$^2$, a region that can be referred to in the LUT 521 is A1. Likewise, when the maximum luminance Lmax1 of the first gamma curve C1 is 300 cd/m$^2$, 202 can be obtained for the third gray data G3 and the fourth gray data G4 by performing the first conversion process on the maximum value of 255 of the first gray data G1 and the second gray data G2 using Equation (4). Therefore, when the maximum luminance Lmax1 of the first gamma curve C1 is 300 cd/m$^2$, a region that can be referred to in the LUT 521 is A2.

As apparent from the above description, the size of a region that can be referred to in the LUT 521 may increase when the maximum luminance Lmax1 of the first gamma curve C1 increases. When the maximum luminance Lmax1 of the first gamma curve C1 increases, the size of the region that can be referred to in the LUT 521 at least does not decrease. In other words, when the maximum luminance Lmax1 of the first gamma curve C1 decreases, the size of the region that can be referred to in the LUT 521 may be reduced.

According to some embodiments, when a value corresponding to the third gray data G3 is not available in the first data group R1, it may be determined that the third gray data G3 corresponds to a value, which is greater than and most approximate to the value of the third gray data G3, in the first data group R1. According to some embodiments, when a value corresponding to the third gray data G3 is not available in the first data group R1, it may be determined that the third gray data G3 corresponds to a value, which is smaller than and most approximate to the value of the third gray data G3, in the first data group R1. Using other various methods, the value of the third gray data G3 can also be approximated to a value of the first data group R1. The same substantially applies to the fourth gray data G4.

According to some embodiments, when the third gray data G3 and the fourth gray data G4 are substantially the same, the reference unit 520 may generate the fifth gray data G5 to be substantially the same as the third gray data G3 and the fourth gray data G4 without referring to the LUT 521.

According to an embodiment, the first conversion unit 510 converts the first gray data G1 and the second gray data G2 into the third gray data G3 and the fourth gray data G4 which correspond to a luminance on the second gamma curve C2 set in the LUT 521. Therefore, even if the maximum luminance Lmax1 of the first gamma curve C1 is changed, the LUT 521 can still be referred to. Therefore, one LUT may be applicable to one gamma. That is, even if the maximum luminance Lmax1 of the first gamma curve C1 is changed, the gray compensator 500 can perform its function using only one LUT. This can reduce memory required for storing LUTs.

Referring back to FIG. 3, according to some embodiments, the gray compensator 500 may further include the second conversion unit 530. The second conversion unit 530 converts gray data into another gray data. In the embodiment of FIG. 3, the second conversion unit 530 generates the sixth gray data G6 based on the fifth gray data G5 received from the reference unit 520. The sixth gray data G6 may be the compensated gray data CGD in FIG. 1 and may be, for example, the compensated gray data CGD for the image of the second frame.

The second conversion unit 530 may generate the sixth gray data G6 by performing a second conversion process on the fifth gray data G5. Since gray data generated by performing the second conversion process on the fifth gray data G5 is a value generated through the first conversion process and the second conversion process, it can also be referred to as 'secondary converted gray data.' In the second conversion process, gray data corresponding to a specific luminance on the second gamma curve C2 may be converted into gray data corresponding to a luminance, which is equal to the specific luminance, on a third gamma curve. The second conversion process will now be described in greater detail with reference to FIG. 6.

Figure 6:
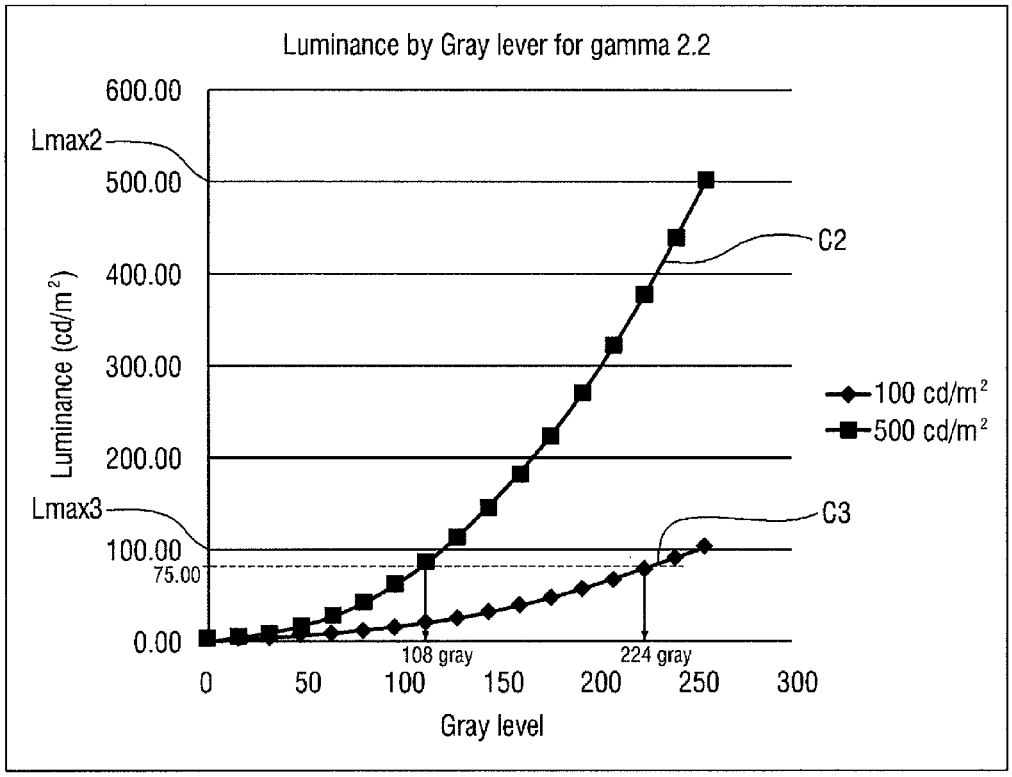
FIG. 6 is a graph of a second gamma curve and a third gamma curve according to an embodiment.

FIG. 6 is a graph of a second gamma curve and a third gamma curve according to an embodiment.

Referring to FIG. 6, the x axis of a gamma curve graph represents gray data, and the γ axis represents luminance corresponding to the gray data. A description of a gamma curve is the same as the above description of Equation (1).

In FIG. 6, a second gamma curve C2 is a gamma curve corresponding to a case where Lmax is 500 cd/m$^2$ and $\gamma$ is 2.2. In addition, a third gamma curve C2 is a gamma curve whose Lmax is 100 cd/m$^2$ and $\gamma$ is 2.2. The above values of Lmax and $\gamma$ are mere examples and can change according to the settings of the display device.

For example, when gray data on the second gamma curve C2 is 108, a luminance corresponding to the gray data is 75 cd/m$^2$. On the third gamma curve C3, gray data corresponding to the luminance of 75 cd/m$^2$ is 224. The second conversion process converts gray data representing a specific luminance on the second gamma curve C2 into gray data, which represents a luminance equal to the specific luminance, on the third gamma curve C3. Therefore, when the second gamma curve C2 and the third gamma curve C3 are set as illustrated in FIG. 6, the gray data of 108 may be converted into the gray data of 224 in the second conversion process.

If the maximum luminance of the second gamma curve C2 is Lmax2 and if gray data is gray2, the second gamma curve C2 may be defined by Equation (3).

If the maximum luminance of the third gamma curve C3 is Lmax3 and if gray data is gray3, the third gamma curve C3 may be defined by Equation (5).

$$\frac{L}{Lmax3} = \left(\frac{gray3}{255}\right)^{\gamma}. \tag{5}$$

As assumed above, the second process converts gray data of a gamma curve into gray data, which corresponds to a luminance of the gray data, on a different gamma curve. Therefore, luminances L of Equations (3) and (5) are equal. Accordingly, Equations (3) and (5) can be combined and rearranged into Equation (6) for gray2.

$$gray3 = \left(\frac{Lmax2}{Lmax3}\right)^{\frac{1}{\gamma}} \times gray2. \tag{6}$$

That is, the second conversion process converts gray2 into gray3 using Equation (6).

According to some embodiments, the maximum luminance Lmax3 of the third gamma curve C3 may be equal to the set maximum luminance of the display panel 400. According to some embodiments, the third gamma curve C3 may be substantially the same as the first gamma curve C1. If the first gamma curve C1 and the third gamma curve C3 are substantially the same, a third conversion process may be an inverse process of the first conversion process. According to some embodiments, the third gamma curve C3 may be a gamma curve corresponding to the set gamma and maximum luminance of the display panel 400. If the third gamma curve C3 is a gamma curve corresponding to the set gamma and maximum luminance of the display panel 400, when the data driver 200 generates the gray signals D1 through Dm corresponding to the compensated gray data CGD which is generated from the sixth gray data G6, the display panel 400 may display an image corresponding to the set gamma and maximum luminance.

According to some embodiments, the maximum luminance Lmax2 of the second gamma curve C2 may be higher than the maximum luminance Lmax3 of the third gamma curve C3. If Lmax2 is higher than Lmax3 and if a luminance value, which corresponds to the fifth gray data G5, on the second gamma curve C2 is higher than Lmax2, the sixth gray data G6 may have a maximum value. For example, when the sixth gray data G6 has 8 bits, it may have a value of 255.

According to some embodiments, since the gray compensator 500 includes the first conversion unit 510, the reference unit 520 and the second conversion unit 530, even when the set maximum luminance of the display panel 400 is different from the maximum luminance of a gamma curve set for the LUT 521, the first conversion process is performed on gray data such that the gray data corresponds to the maximum luminance of the gamma curve set for the LUT 521. After the first conversion process, the LUT 521 is referred to, and the second conversion process is performed on a result of referring to the LUT 521 such that the result corresponds to the maximum luminance of the gamma curve set for the display panel 400. This can prevent the occurrence of a phenomenon such as overshoot, thereby improving the display quality and reducing the response time.

FIG. 7 is an LUT 1521 according to another embodiment.

Referring to FIG. 7, the LUT 1521 includes a first data group R3 on an axis, a second data group R4 on the other axis, and output data OD2 arranged in a matrix.

In the first data group R3 of the LUT 1521, as values become smaller, an interval between them may be reduced. In the second data group R4 of the LUT 1521, as values become smaller, an interval between them may also be reduced. As described above in the LUT 521 of FIG. 5, when the maximum luminance Lmax1 of the first gamma curve C1 decreases in the LUT 521 or 1521, the size of a region that can be referred to in the LUT 521 or 1521 may be reduced. Therefore, when the maximum luminance Lmax1 of the first gamma curve C1 decreases, since the number of pieces of the output data OD or OD2 that can be referred to is reduced, the resolution of the fourth gray data G4 may be reduced. In the LUT 1521, the interval between the values of the first data group R3 and the interval between the values of the second data group G4 may be reduced as the values become smaller. In this case, even if the maximum luminance Lmax1 of the first gamma curve C1 is reduced, a reduction in the size of the region that can be referred to can be reduced. Accordingly, a reduction in the resolution of the fourth gray data G4 can be reduced. Therefore, gray levels of an image displayed on the display panel 400 can be expressed in detail.

Figure 8:
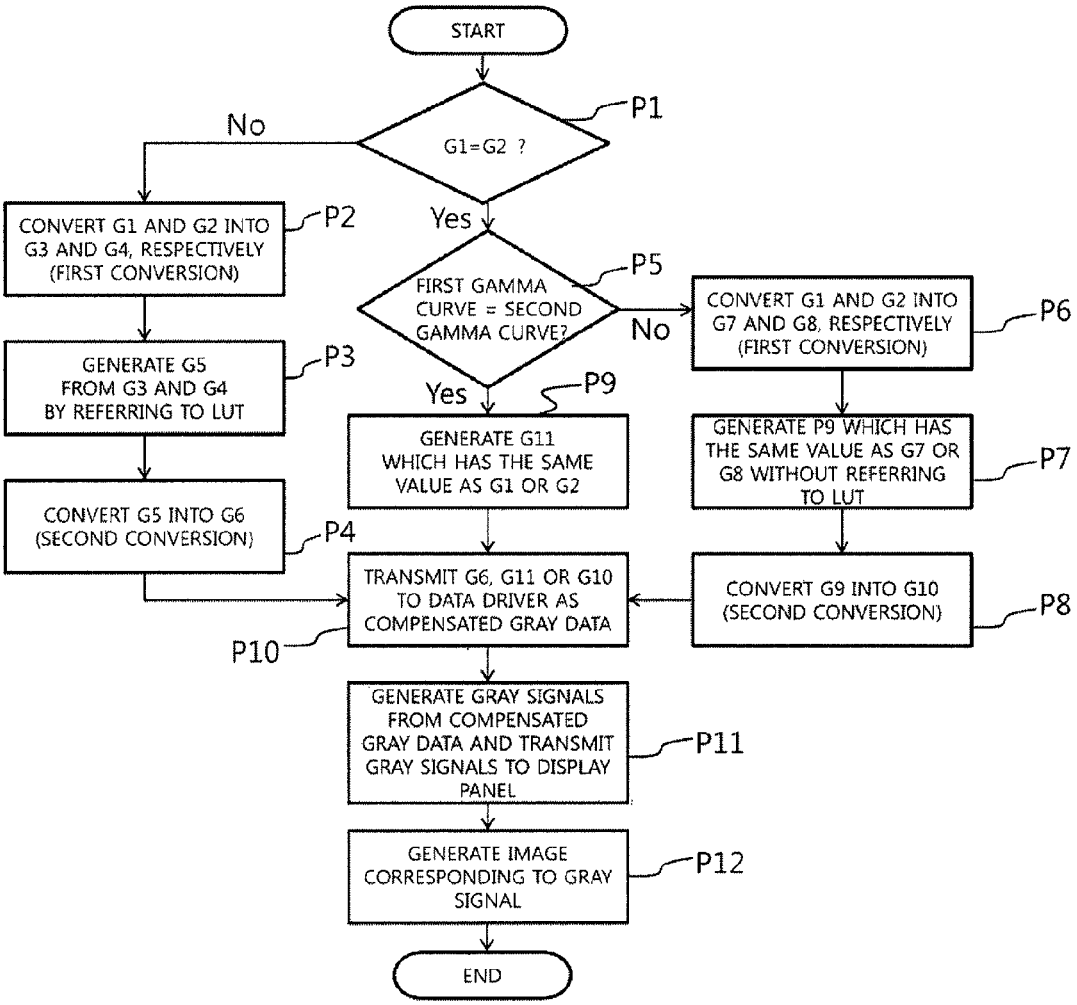
FIG. 8 is a flowchart illustrating a method of driving a display device according to an embodiment.

FIG. 8 is a flowchart illustrating a method of driving a display device according to an embodiment. Depending on the embodiment, the order of the operations can be changed, and certain operations may be omitted, and additional operations may be added. First through sixth gray data G1 through G6 in FIG. 8 may be different from the first through sixth gray data G1 through G6 in FIG. 3.

Referring to FIG. 8, the method of driving a display device may include determining whether the first gray data G1 is substantially the same as the second gray data G2 (operation P1). According to some embodiments, the first gray data G1 may be gray data of a first frame, and the second gray data G2 may be gray data of a second frame which follows the first frame.

When the first gray data G1 and the second gray data G2 are not substantially the same, the driving method may include generating the third gray data G3 and the fourth gray data G4 by performing a first conversion process on the first gray data G1 and the second gray data G2, respectively (operation P2). The first conversion process may be substantially the same as the first conversion process described above with reference to FIGS. 3 and 4.

The driving method may include generating the fifth gray data G5 from the third gray data G3 and the fourth gray data G4, which are generated in operation P2, by referring to a LUT (operation P3). The LUT may be the LUT 521 of FIG. 5 or the LUT 1521 of FIG. 7 and can be modified in various other forms.

The driving method may include generating the sixth gray data G6 by performing a second conversion process on the fifth gray data G5 generated in operation P3 (operation P4). The second conversion process may be substantially the same as the second conversion process in FIGS. 3 and 6.

When the first gray data G1 and the second gray data G2 are substantially the same, the driving method may include determining whether a first gamma curve C1 and a second gamma curve C2 are substantially the same (operation P5). According to some embodiments, when the gamma value and maximum luminance of the first gamma curve C1 are equal to those of the second gamma curve C2, it can be determined that the first gamma curve C1 is substantially the same as the second gamma curve C2.

When the first gray data G1 and the second gray data G2 are substantially the same and when the first gamma curve C1 and the second gamma curve C2 are different, the driving method may include generating seventh gray data G7 and eighth gray data G8 by performing the first conversion process on the first gray data G1 and the second gray data G2, respectively (operation P6).

The driving method may include generating ninth gray data G9, which has substantially the same value as the seventh gray data G7 or the eighth gray data G8 generated in operation P6, without referring to the LUT (operation P7).

The driving method may include generating tenth gray data G10 by performing the second conversion process on the ninth gray data G9 generated in operation P7 (operation P8).

When the first gamma curve C1 and the second gamma curve C2 are substantially the same, the driving method may include generating eleventh gray data G11 which has substantially the same value as the first gray data G1 or the second gray data G2 (operation P9).

The driving method may include transmitting the sixth gray data G6 generated in operation P4, P8 or P9 to a data driver as compensated gray data. The converted compensated gray data may be substantially the same as the compensated gray data CGD in FIG. 1, and the data driver may be substantially the same as the data driver 200 in FIG. 1.

The driving method may include generating gray signals from the compensated gray data and transmitting the gray signals to a display panel (operation P11). The generating of the gray signals from the compensated gray data may be performed by the data driver. The display panel may be substantially the same as the display panel 400 in FIG. 1.

The driving method may include generating an image corresponding to the gray signals (operation P12). The image may be generated by the display panel. The image may be an image corresponding to the second frame.

At least one of the disclosed embodiments can realize a display device with reduced response time and a method of driving the display device.

While the above embodiments have been described in connection with the accompanying drawings, it is to be understood that the present disclosure is not limited to the disclosed embodiments, but, on the contrary, is intended to cover various modifications and equivalent arrangements included within the spirit and scope of the appended claims.

What is claimed is:

1. A display device comprising:

a gray compensator configured to i) receive first gray data of a first frame and second gray data of a second frame which follows the first frame and ii) generate compensated gray data;

a data driver configured to output gray signals based on the compensated gray data; and a display panel whose gray level is controlled by the gray signals and configured to display an image of the second frame according to a set luminance and a set gamma, wherein the first gray data corresponds to a first luminance of an image of the first frame on a first gamma curve, wherein the second gray data corresponds to a second luminance of the image of the second frame on the first gamma curve, and wherein the gray compensator comprises:

a first conversion unit configured to convert the first gray data and the second gray data respectively into third gray data which corresponds to the first luminance on a second gamma curve and fourth gray data which corresponds to the second luminance on the second gamma curve; and a reference unit configured to generate fifth gray data based on the third gray data and the fourth gray data by referring to a look-up table (LUT), wherein the LUT comprises a first data group, a second data group, and the compensated gray data for the second gamma curve, wherein the reference unit is further configured to generate, as the fifth gray data, the compensated gray data for the second gamma curve at an intersection of a value of the first data group and a value of the second data group, which correspond respectively to the third gray data and the fourth gray data, in the LUT, wherein coordinates formed of i) each value in the first data group and ii) each value in the second data group correspond to any one of the compensated gray data, and wherein a maximum luminance of the second gamma curve is different from the maximum luminance of first gamma curve.

2. The display device of claim 1, wherein when a luminance of white color on the first gamma curve is L1, a luminance of the white color on the second gamma curve is L2, the first gray data or the second gray data is X, the third gray data or the fourth gray data is X', and a gamma in the first gamma curve and the second gamma curve is γ, the first conversion unit is further configured to perform the conversion based on an equation defined by $X'=(L1/L2)^{(1/\gamma)}\times X$.

3. The display device of claim 1, wherein the gray compensator further comprises a second conversion unit configured to convert the fifth gray data into sixth gray data which corresponds to a third luminance on a third gamma curve, and wherein the fifth gray data corresponds to the third luminance on the second gamma curve.

4. The display device of claim 3, wherein when a luminance of the white color on the second gamma curve is L2, a luminance of the white color on the third gamma curve is L3, the fifth gray data is Y', the sixth gray data is Y, and a gamma in the second gamma curve and the third gamma curve is γ, the second conversion unit is further configured to perform the conversion based on an equation defined by $Y=(L2/L3)^{(1/\gamma)}\times Y'$.

5. The display device of claim 3, wherein the maximum luminance of the third gamma curve is substantially equal to the set maximum luminance, wherein a gamma of the third gamma curve is substantially equal to the set gamma, and wherein the sixth gray data is substantially the same as the compensated gray data.

6. The display device of claim 3, wherein when the maximum luminance of the first gamma curve is substantially equal to the set maximum luminance and when the first gray data is substantially the same as the second gray data, the second gray data is substantially the same as the compensated gray data.

7. The display device of claim 6, wherein when the maximum luminance of the first gamma curve is not substantially equal to the set maximum luminance and when the third gray data is substantially the same as the fourth gray data, the third gray data is substantially the same as the fifth gray data.

8. The display device of claim 1, wherein the maximum luminance of the second gamma curve is substantially equal to the maximum value that the set maximum luminance can have.

9. The display device of claim 1, wherein as values in the first data group become smaller, an interval between the values in the first data group is reduced, and as values in the second data group become smaller, an interval between the values in the second data group is reduced.

10. A display device comprising:

a gray compensator configured to i) receive first gray data of a first frame and second gray data of a second frame which follows the first frame and ii) generate compensated gray data;

a data driver configured to output gray signals based on the compensated gray data; and a display panel whose gray level is controlled by the gray signals and configured to display an image of the second frame according to a set luminance and a set gamma, wherein the first gray data corresponds to a first luminance of an image of the first frame on a first gamma curve, wherein the second gray data corresponds to a second luminance of the image of the second frame on the first gamma curve, and wherein the gray compensator comprises:

a first conversion unit configured to convert the first gray data and the second gray data respectively into third gray data which corresponds to the first luminance on a second gamma curve and fourth gray data which corresponds to the second luminance on the second gamma curve; and a reference unit configured to generate fifth gray data based on the third gray data and the fourth gray data by referring to a look-up table (LUT), wherein the LUT comprises a first data group, a second data group, and compensated gray data for the second gamma curve, wherein the reference unit is further configured to generate, as the fifth gray data, the compensated gray data for the second gamma curve at an intersection of a value of the first data group and a value of the second data group, which correspond respectively to the third gray data and the fourth gray data, in the LUT, wherein coordinates formed of i) each value in the first data group and ii) each value in the second data group correspond to any one of the compensated gray data, wherein the first conversion unit is further configured to convert gray data which corresponds to a first luminance on a first gamma curve into gray data which corresponds to the first luminance on a second gamma curve, and wherein the gray compensator further comprises a second conversion unit configured to convert gray data which corresponds to a second luminance on the second gamma curve into gray data which corresponds to the second luminance on a third gamma curve.

* * * * *